US011123838B1

(12) United States Patent
Scarborough

(10) Patent No.: US 11,123,838 B1
(45) Date of Patent: Sep. 21, 2021

(54) SHEETROCK GRINDER POWER HAND TOOL

(71) Applicant: Jack Huffman Scarborough, Houston, TX (US)

(72) Inventor: Jack Huffman Scarborough, Houston, TX (US)

( * ) Notice: Subject to any disclaimer, the term of this patent is extended or adjusted under 35 U.S.C. 154(b) by 0 days.

(21) Appl. No.: 16/459,586

(22) Filed: Jul. 1, 2019

(51) Int. Cl.
*B24B 23/02* (2006.01)
*B24D 13/14* (2006.01)
*B24B 7/18* (2006.01)

(52) U.S. Cl.
CPC ..... *B24B 23/02* (2013.01); *B24B 7/182* (2013.01); *B24B 7/188* (2013.01); *B24D 13/145* (2013.01)

(58) Field of Classification Search
CPC ..... B24B 23/02; B24B 23/00; B24B 7/182; B24B 7/18; B24B 7/188; B24D 13/02; B24D 13/06; B24D 13/20
USPC ..... 451/360, 358, 352, 354, 541, 547
See application file for complete search history.

(56) References Cited

U.S. PATENT DOCUMENTS 1,011,490 A * 12/1911 Rasmesen ..... B24B 23/02 451/358
1,087,068 A * 2/1914 Lueck ..... A47L 13/02 30/476
1,650,035 A * 11/1927 Peterson ..... A47L 11/164 451/353
1,900,331 A * 3/1933 Clarke ..... B24B 7/18 451/352
1,963,357 A * 6/1934 Filley ..... B24D 13/02 451/538
2,085,202 A * 6/1937 Sauer ..... B24D 13/06 407/29.13
3,178,863 A * 4/1965 Mikiya ..... A47L 11/4058 451/505
3,237,348 A * 3/1966 Block ..... B24D 13/04 451/182
3,711,261 A * 1/1973 Burns ..... B24D 13/06 451/469
4,805,349 A * 2/1989 Demetrius ..... B24B 23/02 15/52.1
4,993,192 A * 2/1991 Demetrius ..... B24B 23/02 15/111
5,890,953 A * 4/1999 Evensen ..... B24B 7/28 451/490
6,212,778 B1 * 4/2001 Carter ..... B24B 23/02 30/124
6,280,309 B1 * 8/2001 Van Osenbruggen ... A46B 9/06 451/359
6,375,557 B1 * 4/2002 Spangenberg ..... B23Q 11/0046 451/344
6,500,054 B1 * 12/2002 Ma ..... B24B 37/26 451/443

(Continued)

*Primary Examiner* — Eileen P Morgan
*Assistant Examiner* — Marcel T Dion
(74) *Attorney, Agent, or Firm* — Karen B. Tripp

(57) ABSTRACT

A hand-held electric power tool for grinding sheetrock particularly adapted to making butt joints have a tapered or recessed juncture for filing with tape embedded with mud such that the joints are ready for painting or covering with wallpaper without being noticeable. The tool includes a grinding cylinder with barbs protruding therefrom which cut or grind the sheetrock edges without penetrating the full depth of the sheetrock or otherwise weakening or damaging the butt joint.

13 Claims, 5 Drawing Sheets

(56) References Cited

U.S. PATENT DOCUMENTS

| | | | | |
|---|---|---|---|---|
| 7,022,003 | B1 * | 4/2006 | Hughes | A47L 11/18 451/352 |
| 7,300,339 | B2 * | 11/2007 | Gaul | B24B 55/052 451/358 |
| 8,197,309 | B2 * | 6/2012 | Lee | B24D 13/20 451/342 |
| 8,480,457 | B2 * | 7/2013 | Kundel, Jr. | B24B 23/02 15/23 |
| 2003/0092370 | A1 * | 5/2003 | Lundum | A46B 3/02 451/466 |
| 2003/0228834 | A1 * | 12/2003 | Furey | A47J 37/0786 451/358 |
| 2004/0157540 | A1 * | 8/2004 | Wendt | B23Q 11/0046 451/358 |
| 2005/0124275 | A1 * | 6/2005 | Wuensch | B24B 23/00 451/538 |
| 2009/0119932 | A1 * | 5/2009 | Lau | B26B 19/06 30/355 |
| 2010/0144251 | A1 * | 6/2010 | Farrell | B24B 23/02 451/358 |
| 2010/0151774 | A1 * | 6/2010 | Bower | B24B 23/02 451/344 |
| 2011/0237167 | A1 * | 9/2011 | Ouellette | B24B 49/00 451/358 |
| 2019/0015945 | A1 * | 1/2019 | Ankersen | B24D 13/12 |

* cited by examiner

SHEETROCK GRINDER POWER HAND TOOL

FIELD OF THE INVENTION

The present invention relates to a sheetrock tool, specifically to use on sheetrock, drywall, plasterboard, or other gypsum board, or cement board, where a flat, smooth, even joint is required. More specifically, it relates to a hand tool and method for preparing butt joints where two untapered panels of sheetrock come together or are joined.

BACKGROUND OF THE INVENTION

The most common material used in constructing walls and ceilings of buildings today is heavy paper-wrapped sheets or panels of gypsum board, commonly called drywall, plasterboard, or sheetrock. As used herein, the term "sheetrock" shall be understood to include such heavy paper-wrapped sheets or panels of gypsum board, and other similar or like materials. Generally, such sheetrock panels are produced in lengths up to 16 feet and standard widths are 48 inches and 58 inches. The long edges are tapered slightly to accommodate joint tape and setting compound (commonly called "mud") for a smooth connection where the panels meet so the wall is ready for finishing with paint or wall paper without evidence of an underlying seam or joint of sheetrock panels. When two tapered edges of sheetrock meet, they create a shallow recess that makes taping easy—a constructor needs to just pass or drag a knife over the joint, fill the joint with setting compound, and repeat such passes about one to three times or until the joint is smooth and flat. That is, the tapered edge of the two sheetrock panels come together to form a recess which allows room for the tape to be embedded in or with setting compound without forming a bump so the edges are easy to conceal. See FIG. 1 which shows a tapered joint of sheetrock.

However, the sheetrock panel ends are not tapered. Rather, they are cut square and finished smooth with the gypsum core exposed. Similarly, whenever a constructor or other sheetrock installer cuts a sheetrock panel, the cut edge is also untapered. Without the taper, there is no recessed area for embedding the tape in the setting compound or mud, and the butt end joints are at the actual height of the sheetrock. See FIG. 2. Applying the tape automatically brings the height of the joint higher than that of the surface of the drywall board. Thus, traditional sheetrock installation involves attaching the abutting edges of the sheetrock to a joist or stud, then covering the joint with a mound of tape and setting compound, and spreading the mound out very wide, at least about 12 inches to about 16 inches typically, in an attempt to make the seam or joint less noticeable. This requires many layers of joint or setting compound to be applied at different widths for each application. Sanding the joint surface between each layer may also be done to help obtain a flat surface.

Such sheetrock "butt" joints have been considered the weakest point and the biggest problem on sheetrock jobs for nearly a hundred years. Even with the best finisher, feathering the butt joint as much as 32 inches wide can still result in the joint being noticeable due to a resulting lump from the tape and mud over the joint. Further, butt joints almost inevitably fall in the center of a great room or large kitchen in an area of high visibility, despite efforts to avoid them.

One technique offered to eliminate unsightly sheetrock butt joints has been a back blocking device for providing a beveled recess to tape and coat by pulling the edges of the sheetrock panels toward the device, to cause a space for embedding the tape in mud over the joint. The device attaches to the sheetrock, not a joist, and installs behind the sheetrock joint, so as to enable the pulling of the edges toward it. See FIG. 3. Care must be taken that the sheetrock butt edges come together over such device and not over a joist or stud.

The back blocking device and method have been known and used or at least tried for a number of years, but they are not always successful in eliminating the butt joint bump, nor is it always possible to use the device—some situations simply don't lend themselves to the conditions required for use of the device. Consequently a need continues to exist for better ways of joining butt edges of sheetrock.

BRIEF DESCRIPTION OF THE DRAWINGS

In the drawings a more detailed and complete appreciation of the present invention and various advantages can be realized by reference to the detailed description that will accompany the drawings in which.

REFERENCE NUMERALS IN DRAWINGS

Figure 1:
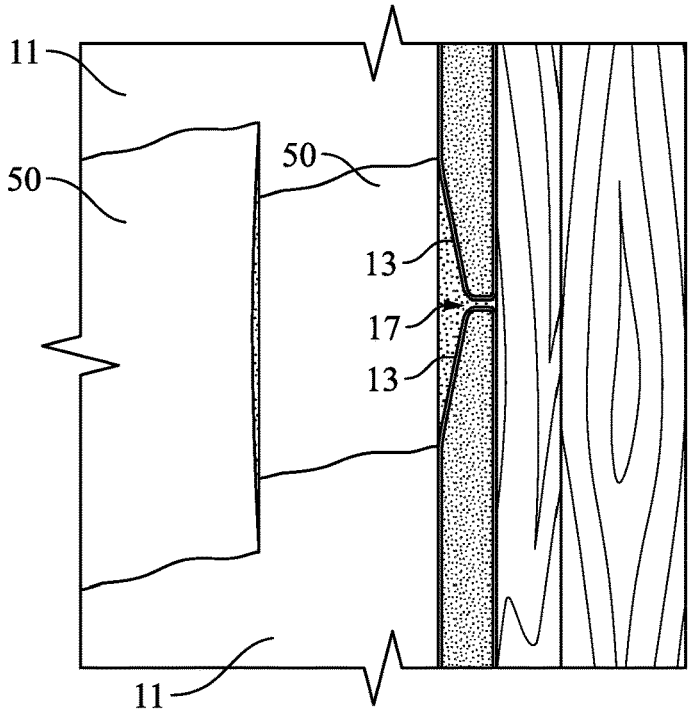
FIG. 1 (Prior Art)
FIG. 1 is a diagram showing a sheetrock joint where the tapered edges of two panels of sheetrock meet (prior art).
Figure 2:
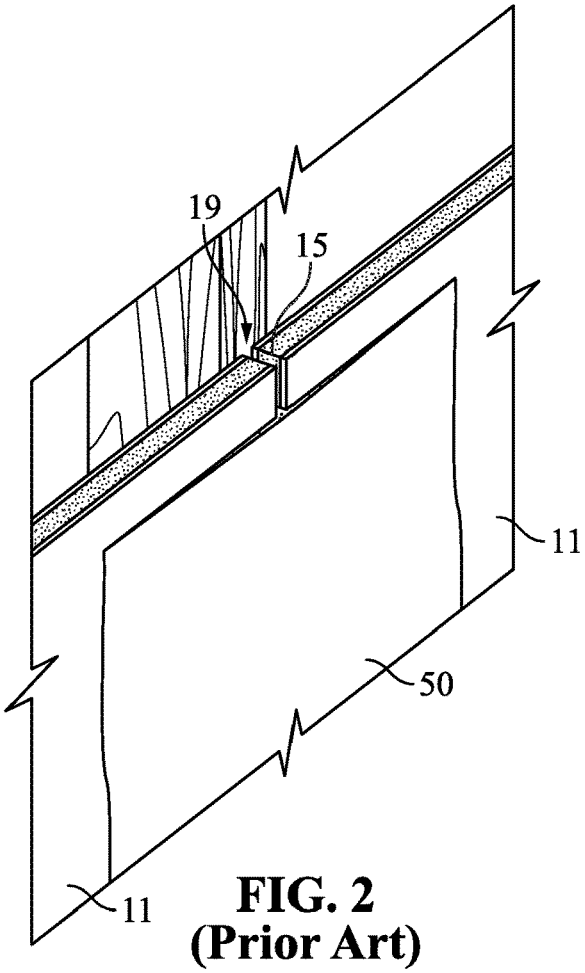
FIG. 2 (Prior Art)
FIG. 2 is a diagram showing a sheetrock butt joint where the untapered end or butt edges of two panels of sheetrock meet (prior art).
Figure 3:
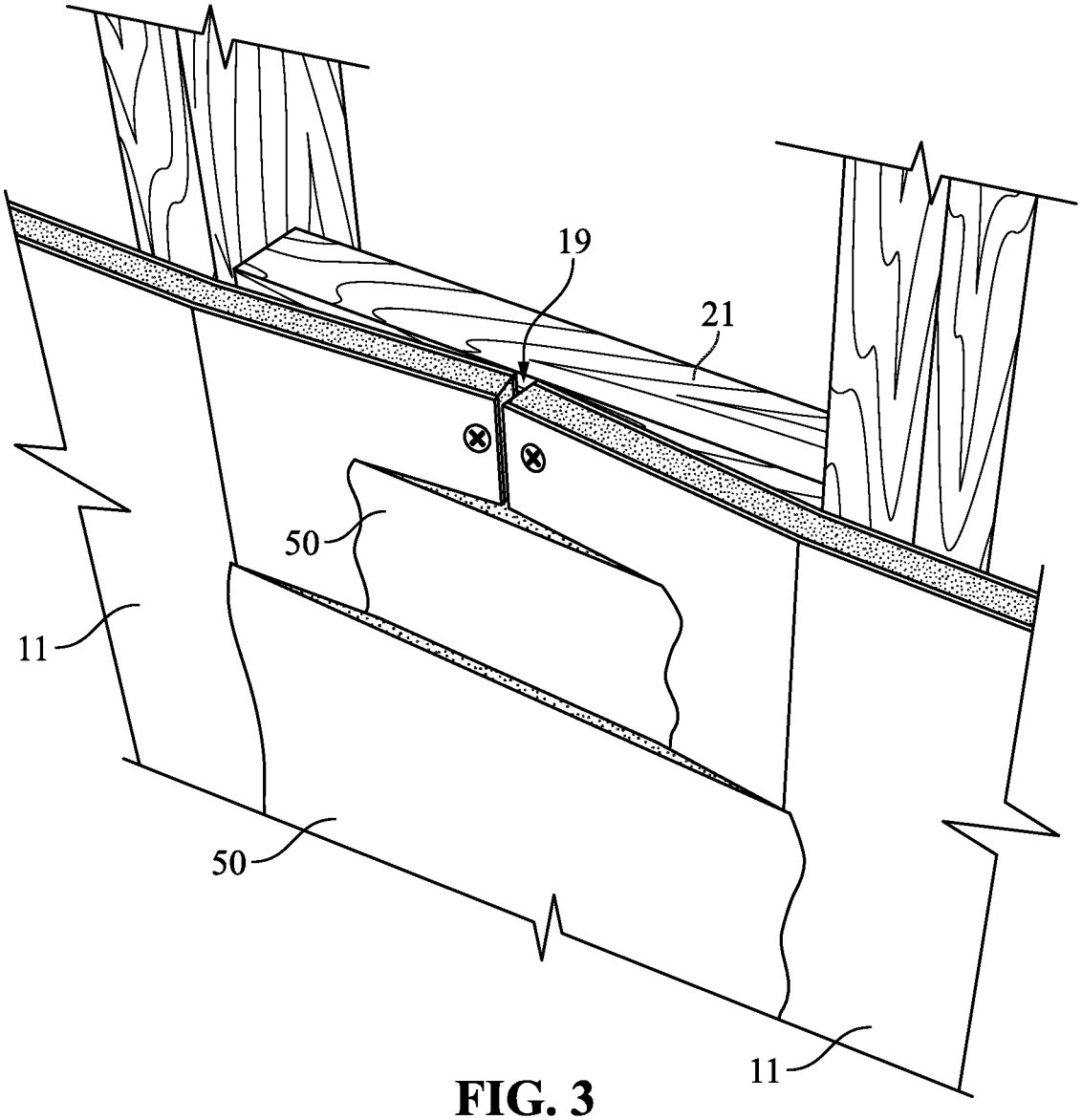
FIG. 3 (Prior Art)
FIG. 3 is a diagram showing a back blocking device in use behind a sheet rock butt joint (prior art).

10 one embodiment of the apparatus of the invention
11 sheetrock
12 housing
13 tapered edge(s) of sheetrock
14 handle
15 square edge of sheetrock
16 depth adjuster knob
17 joint or tapered joint between tapered edges of two panels of sheetrock
18 debris exit hole
19 butt joint between square edges of two panels of sheetrock
20 cylinder
21 block
22 electric motor
23 power cord
24 support
25 depth adjuster lever
26 barbs on cylinder
27 depth adjuster spring
28 cylinder connector rod
29 cylinder connector rod spring
30 pulley wheel
31 pulley band
32 bristles
33 depth adjuster bar or rod
34 base or bottom
35 wire brush cylinder
36 cylinder barbs near ends of cylinder
37 cylinder barbs near middle of cylinder
38 debris channel
39 motor belt pulley wheel
40 sanding cylinder
41 cut pattern
42 sanding grit
50 setting compound or "mud"

SUMMARY OF THE INVENTION

The present invention provides a hand-held, motorized apparatus for use on sheetrock butt joints to cause the joints to perform more like tapered joints from beveled edged sheetrock. That is, the invention allows butt joints to be more easily hidden and finished so as not to be noticed when painted or covered with wallpaper. The apparatus of the invention accomplishes this advantage by grinding the butt edges so that they have a bevel, without cutting through the edge entirely or otherwise unduly weakening the joint.

The apparatus of the invention has a housing, including a top, at least one side and a bottom, as well as a handle for guiding the apparatus along the sheetrock surface. Extending partially below the bottom of the apparatus is a rotatable cylinder with surface protrusions such as barbs extending outward from the cylinder surface. The protrusions are capable of cutting into the surface but not through the entirety of the sheetrock. The depth the protrusions can cut into the sheetrock is adjustable. In use, the motor turns the rotatable cylinder for cutting the surface of the sheetrock, as guided by the user along the surface.

DETAILED DESCRIPTION

The present invention provides an apparatus, a hand-held power tool, which is used to grind the surface of sheetrock butt joints 19 to have tapered edges 13 for an easy to hide seam and a smooth finish ready for painting or wall papering.

Figure 4:
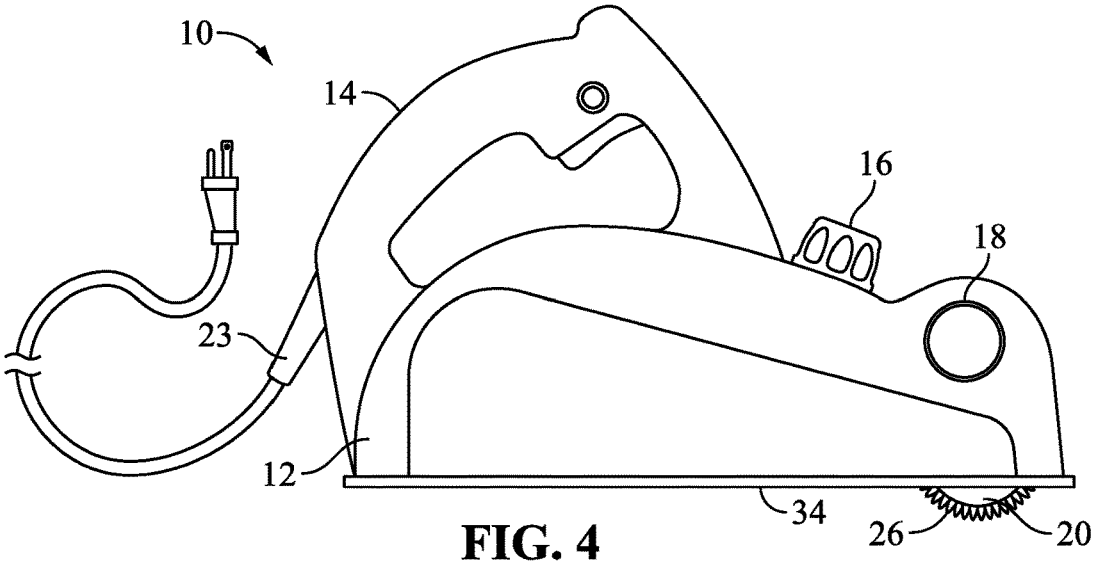
FIG. 4 is a side view of one embodiment of the apparatus of the invention.
Figure 5:
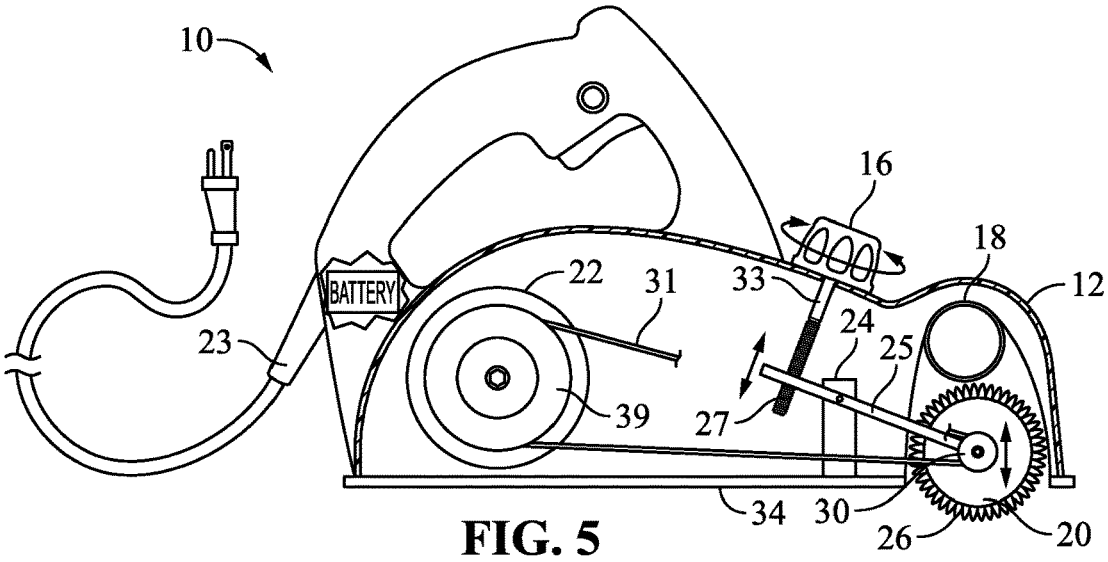
FIG. 5 is an inside side view of the embodiment of the apparatus of the invention of FIG. 4 with the top and side of the housing removed.
Figure 6:
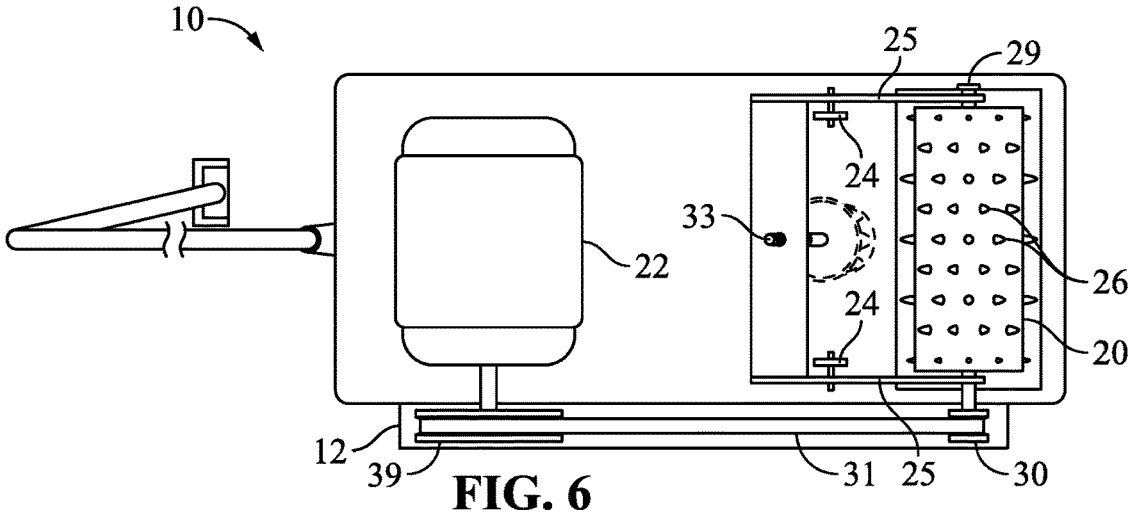
FIG. 6 is bottom view of the apparatus of the invention of FIG. 4.

Referring to the Figures, one embodiment of the apparatus of the invention 10 is illustrated. Apparatus 10 has a housing, typically comprised of hard plastic for lightness in weight and general durability, with a handle 12 for a user to hold and guide the apparatus in operation along sheetrock 11, and particularly along sheetrock butt joints 19. Apparatus 10 has an electric motor 22, which as shown in FIG. 4 has a power cord 23. Alternatively, or in another embodiment, electric motor 22 could be powered by a battery (not shown), preferably rechargeable. Motor 22 powers the grinding cylinder 20 with barbs 26 which accomplishes the purpose of the invention—reducing sheetrock square edges and butt joints to tapered edges and joints for a smooth and apparently "seamless" finish for painting or wallpapering.

The grinding cylinder 20 is rotatable by positioning it on cylinder connector rod 28 attached to a pulley wheel 30 on one end and a cylinder connector rod spring 29 on the other end. A pulley band 31 extending from motor 22 to pulley wheel 30 turns or rotates cylinder 20. A depth adjuster lever 25 supported by a support 24 (on base or bottom 34 of housing 12) holds cylinder 20 in position for operation. The depth adjuster lever 25 in turn is associated with a depth adjuster bar or rod 33, manually controlled and set by a depth adjuster knob 16 extending out of housing 12 (for accessibility by the user) and connected through depth adjuster spring 27 to the base or bottom 34 of housing 12. Turning the depth adjuster knob 16 raises or lowers the depth adjuster bar or rod 33 which in turn causes the depth adjuster lever 25 to move up or down and in turn causes the cylinder 20 to move higher or lower (up or down) so that it penetrates sheet rock 11 and sheet rock butt joints 19 less or more as desired.

In an alternative embodiment, the base or bottom 34 could move up or down and the cylinder 20, directly or indirectly supported by the base or bottom 34, could in turn move up or down or penetrate sheetrock less or more as desired by adjusting the base or bottom 34 of the apparatus.

In still another alternative embodiment, the base or bottom 34 is itself on a spring so that it has some flexibility to move slightly up and down as the apparatus 10 moves across sheetrock 11. Such flexibility may be beneficial in moving the apparatus across screws or nails that may be protruding outward from the sheetrock or a sheetrock joint. This alternative ability—for the bottom itself to have some ability to float or move or flex slightly—may be combined if desired with the embodiment shown in the Figures.

Figure 7:
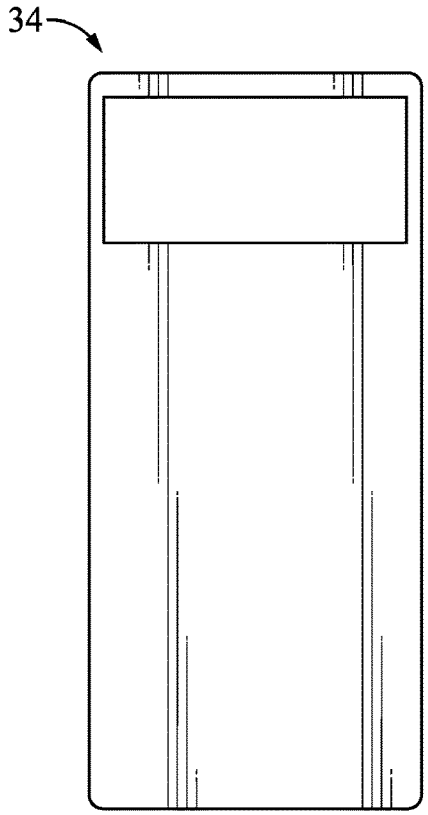
FIG. 7 is a partial view of the bottom of the apparatus of the invention of FIG. 4 with the cylinder removed to show the hole through which the cylinder extends.

FIG. 7 shows a hole in the bottom 34 of apparatus 10 through which cylinder 20 extends for use. In one example embodiment, such hole is about two and three-fourth inches wide and about one and one-half inches long. Such size is particularly suited for a cylinder having barbs about one-eighth to one-sixteenth inch long.

Figure 10:
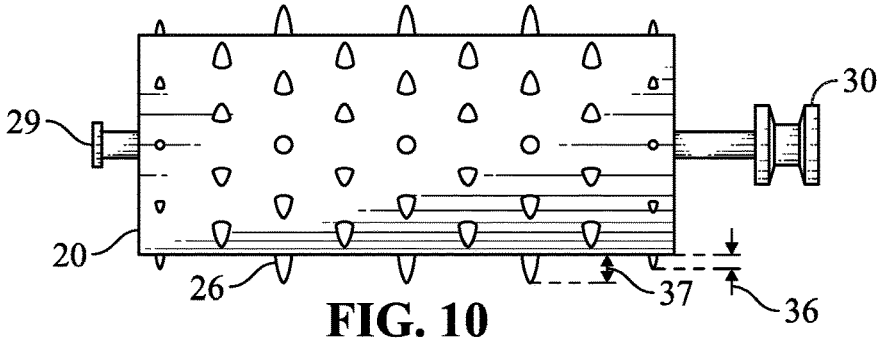
FIG. 10 is a view of the cylinder of the invention of FIGS. 4 and 8 removed from the housing, showing barbs protruding from cylinder and showing the pulley wheel on one end of the cylinder and a spring on the other end of the cylinder to assist in holding the cylinder in place in the housing.

When apparatus 10 is in use, barbs 26 on cylinder 20 cut into the sheetrock. In one embodiment, as shown in the Figures, and particularly FIGS. 8 and 10, the barbs 16 are in a spiral pattern with barbs on the ends of the cylinder 36 shorter than barbs toward the middle or at the middle of the cylinder 37. In one embodiment, the spiral pattern is effected with three rows of barbs. In one embodiment, the barbs on the ends of the cylinder 36 are about one-sixteeth inch in length protruding from the cylinder surface and the barbs near the middle of the cylinder 37 are about one-eighth inch in length protruding from the cylinder surface. In another embodiment, cylinder 20 can comprise barbs at and near the middle of cylinder 20 about one-eighth inch in length, barbs toward the ends of the cylinder 20 about one-sixteenth inch and barbs at the end of the cylinder 20 about one-thirty-second inch. The barbs 26 must not be so long as to cut all the way through the sheet rock. The goal as noted above is for the barbs 26 to cut out a recess or channel, that is, make beveled or tapered edges 13 from the squared edges 15 so that a butt joint 19 more resembles a tapered joint 17 so that the joint can be finished with mud 50 smoothly and the joint will appear seamless or essentially not be noticeable when painted or covered with wall paper.

Operation of apparatus 10, grinding sheetrock 11 with cylinder 20, can result in sheetrock dust. Such dust and sheetrock debris can be largely caught in a bag, such as a vacuum bag (not shown), attached to the housing at hole 18 and preferably in communication or connection through hole 18 to an internal channel 38 adjacent cylinder 20. Such bag is reusable or disposable. While such bag is not necessary to the operation of the apparatus, the bag will enable the user to use the apparatus with less sheetrock dust as a consequence of the use.

In another embodiment of the invention, a cylinder 35 comprising a brush or bristles 32 can be substituted for cylinder 20. Bristles 32 on cylinder 35 can be used for sweeping heavy texture from the surface of sheetrock 11.

In still another embodiment of the invention, a cylinder 40 comprising a gritty surface, such as 80 to 20 grade grit 42, can be substituted for cylinder 20. The grit 42 can be used for removing sheetrock texture and heavy paint.

Figure 8:
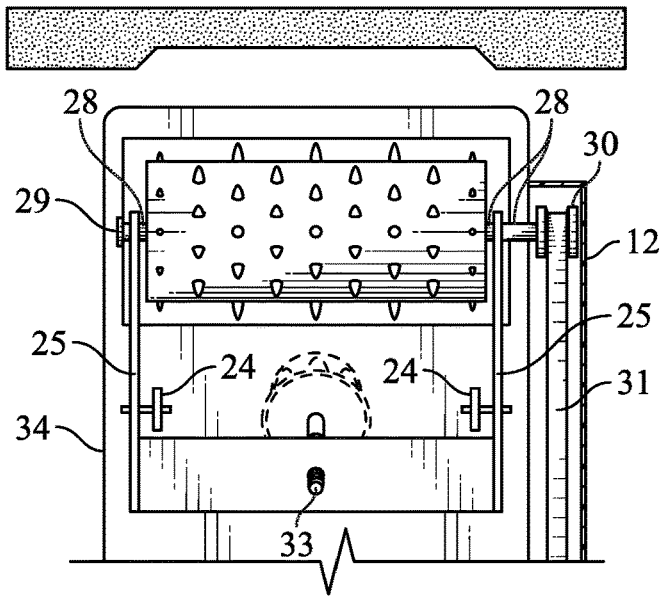
FIG. 8 is a partial view of the cylinder of the invention of FIG. 4 showing its positioning in the housing and its connection to a depth adjuster lever which is connected to a holder bar affixed to the bottom of the apparatus, and to a pulley wheel which is connected to a motor (shown in FIGS. 4 and 9) for operation, and also illustrating an example cut-pattern of the cylinder.
Figure 9:
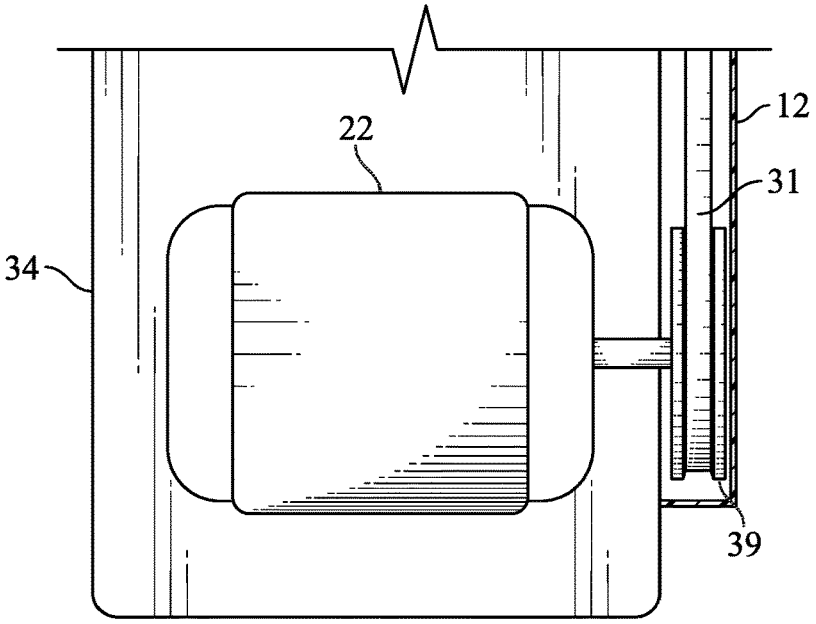
FIG. 9 is a generic diagram of a motor for the invention of FIG. 4, showing that the motor has attached to it a belt pulley wheel for connecting to and operating the cylinder of the invention shown in FIG. 8.
Figure 11:
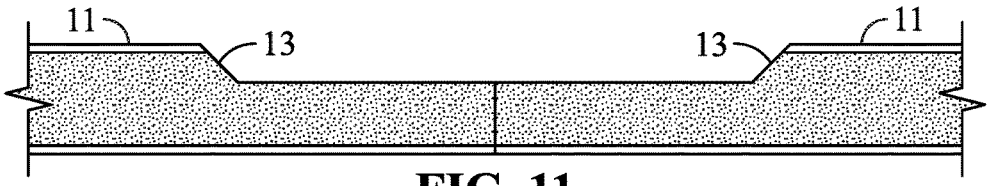
FIG. 11 is a side view diagram of the effect that use of the apparatus of the invention has on square edges (or a butt joint) of sheetrock, resulting in square edges of sheetrock becoming beveled edges.
Figure 12:
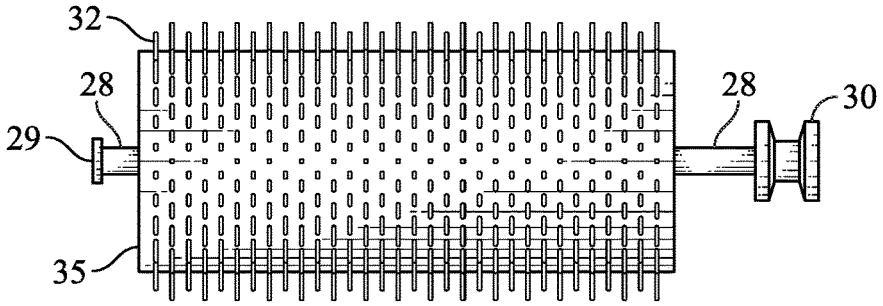
FIG. 12 shows a brush cylinder which may be substituted in the apparatus of the invention for the cylinder shown in FIGS. 4-6, 8, and 10, for sweeping heavy "texture" from a sheetrock surface.
Figure 13:
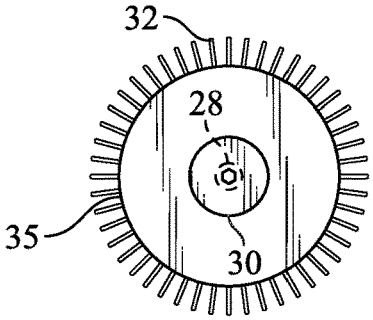
FIG. 13 is an end view of the brush cylinder of FIG. 12.
Figure 14:
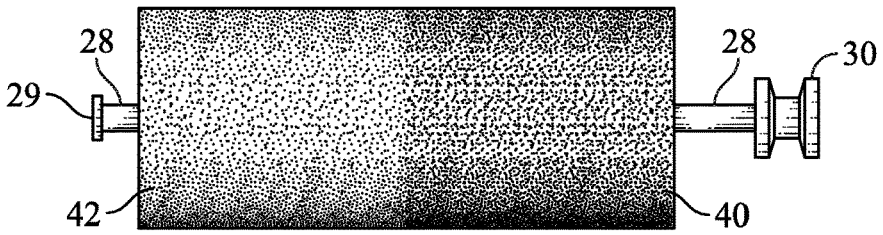
FIG. 14 is a sanding cylinder which may be substituted in the apparatus of the invention for the cylinder shown in FIGS. 4-6, 8, and 10, for removing "texture" and heavy paint from a sheetrock surface.

In using the apparatus of the invention, the apparatus 10 is placed on or pressed against the sheetrock 11 until the cylinder 20 (or cylinder 35 or cylinder 40) touches the sheetrock surface. The apparatus is then turned on—engaging the motor and causing it to turn the cylinder. A user then pushes the apparatus along the surface of the sheetrock surface (holding the handle 14 of the apparatus 10). The cylinder 20 grinds the surface of the sheetrock 11, making a cut as shown in FIG. 11, along a cut pattern 41 as illustrated in FIG. 8 (that is—the movement is typically forward along the sheetrock joint surface).

While preferred embodiments of the present invention have been described, it should be understood that other various changes, adaptations and modifications can be made therein without departing from the spirit of the invention(s) and the scope of the appended claims. The scope of the present invention should, therefore, be determined not with reference to the above description, but instead should be determined with reference to the appended claims along with their full scope of equivalents. Furthermore, it should be understood that the appended claims do not necessarily comprise the broadest scope of the invention(s) which the applicant is entitled to claim, or the only manner(s) in which the invention(s) may be claimed.

What is claimed is:

1. A hand-held apparatus for improving sheetrock butt joints, comprising:

a housing having a top, at least one side, and a bottom;

a handle;

a rotatable cylinder with surface protrusions extending outward from and below said bottom and wherein said protrusions are positioned on the cylinder in rows, forming a spiral pattern and wherein protrusions about one-eighth inch in length are positioned at and near the middle of the cylinder and protrusions about one-sixteenth inch in length are positioned toward the ends of the cylinder, wherein said protrusions are capable of cutting into sheetrock such that when the rotatable cylinder is turned or rotated the surface protrusions cut out a recess or channel in the sheetrock butt joint such that the butt joint resembles a tapered joint with beveled edges that can be finished smoothly with mud so as to appear seamless;

a motor for turning the rotatable cylinder;

a connector between said motor and said rotatable cylinder to facilitate said turning of said rotatable cylinder; and a depth adjuster for raising or lowering the rotatable cylinder such that the cylinder is at a level that when the rotatable cylinder is turned or rotated the surface protrusions cut out a recess or channel in the sheetrock butt joint such that the butt joint resembles a tapered joint with beveled edges that can be finished smoothly with mud so as to appear seamless;

wherein in use the surface protrusions cut out a recess or channel in the sheetrock butt joint such that the butt joint resembles a tapered joint with beveled edges that can be finished smoothly with mud so as to appear seamless.

2. The apparatus of claim 1 further comprising a hole in the housing for attachment of a container or bag for collection of sheetrock debris from operation of the apparatus.

3. The apparatus of claim 1 further comprising a battery for powering the motor for said turning the rotatable cylinder.

4. The apparatus of claim 3 wherein the battery is rechargeable.

5. The apparatus of claim 1 wherein the surface protrusions are barbs.

6. The apparatus of claim 1 wherein the rotatable cylinder is removable and can be interchanged with a rotatable cylinder comprising 80 to 20 grade grit.

7. The apparatus of claim 1 wherein the rotatable cylinder is removable and can be interchanged with a rotatable cylinder comprising a brush or bristles.

8. The apparatus of claim 1 wherein said depth adjuster raises and lowers the rotatable cylinder by raising and lowering the bottom of the apparatus.

9. The apparatus of claim 1 wherein said depth adjuster raises and lowers the rotatable cylinder relative to the bottom of the apparatus.

10. The apparatus of claim 1 wherein the rotatable cylinder with surface protrusions extends outward from and below said bottom through a hole in said bottom.

11. The apparatus of claim 10 wherein said hole is about two and three-fourth inches wide and about one and one-half inches long.

12. A hand-held apparatus for improving sheetrock butt joints, comprising:

a housing having: (a) a top; (b) at least one side; (c) a flexible bottom with a first hole therein, and a (d) second hole for attachment of a container or bag for collection of sheetrock debris from operation of the apparatus;

a handle;

a rotatable cylinder comprising surface protrusions extending outward from and below said first hole in said bottom and wherein said protrusions comprise barbs for cutting into sheetrock, wherein the barbs are positioned on the cylinder in three rows, forming a spiral pattern and wherein barbs about one-eighth inch in length are positioned at and near the middle of the cylinder and barbs about one-sixteenth inch in length are positioned toward the ends of the cylinder, such that the surface protrusions cut out a recess or channel in the sheetrock butt joint so that the butt joint resembles a tapered joint with beveled edges that can be finished smoothly with mud so as to appear seamless;

a motor for turning the rotatable cylinder;

a connector between said motor and said rotatable cylinder to facilitate said turning of said rotatable cylinder; and a depth adjuster for raising or lowering the rotatable cylinder wherein the depth adjuster raises and lowers the bottom of the apparatus which in turn raises and lowers the cylinder such that the cylinder can be placed at a level that when the rotatable cylinder is turned or rotated the surface protrusions cut out a recess or channel in the sheetrock butt joint so that the butt joint resembles a tapered joint with beveled edges that can be finished smoothly with mud so as to appear seamless; and wherein in use the surface protrusions cut out a recess or channel in the sheetrock butt joint such that the butt joint resembles a tapered joint with beveled edges that can be finished smoothly with mud so as to appear seamless.

13. A method for making a sheetrock butt joint resemble a tapered joint with beveled edges that can be finished smoothly with mud so as to appear seamless, the method comprising:

positioning the apparatus of claim 12 over the sheetrock butt joint;

using the depth adjuster of the apparatus, raising or lowering the rotatable cylinder of the apparatus so that the cylinder is positioned at a level that when the rotatable cylinder is turned or rotated the surface protrusions of the apparatus can cut out a recess or channel in the sheetrock butt joint so that the butt joint resembles a tapered joint with beveled edges that can be finished smoothly with mud so as to appear seamless; and operating the apparatus over the butt joint so that the surface protrusions of the apparatus cut out a recess or channel in the sheetrock butt joint such that the butt joint resembles a tapered joint with beveled edges that can be finished smoothly with mud so as to appear seamless.

* * * * *